United States Patent [19]

Brennan

[11] Patent Number: 4,997,085

[45] Date of Patent: Mar. 5, 1991

[54] WRENCH ORGANIZER TRAY

[76] Inventor: Thomas P. Brennan, One Burr Ave., Morganville, N.J. 07751

[21] Appl. No.: 513,853

[22] Filed: Apr. 24, 1990

[51] Int. Cl.[5] ..... B65D 85/20

[52] U.S. Cl. ..... 206/376; 206/493; 211/70.6

[58] Field of Search ..... 206/373–379, 206/493; 211/70.6

[56] References Cited

U.S. PATENT DOCUMENTS

| | | | |
|---|---|---|---|
| 1,712,473 | 5/1929 | McWethy | 206/493 |
| 1,967,458 | 9/1933 | Vallone . | |
| 3,702,136 | 11/1972 | Albertson | 206/376 |
| 3,726,393 | 4/1973 | Thompson | 206/378 |
| 4,337,860 | 7/1982 | Carrigan | 206/493 |
| 4,421,230 | 12/1983 | Stanton | 206/378 |
| 4,460,085 | 7/1984 | Jantzen . | |
| 4,621,738 | 11/1986 | Delucchi | 206/378 |
| 4,688,672 | 8/1987 | Pemberton | 206/493 |
| 4,705,168 | 11/1987 | Ward | 206/376 |
| 4,711,353 | 12/1987 | Rozmestor | 206/378 |
| 4,911,297 | 3/1990 | Suburu | 206/376 |
| 4,927,020 | 5/1990 | Randy | 206/378 |

*Primary Examiner*—Jimmy G. Foster

*Attorney, Agent, or Firm*—Cushman, Darby & Cushman

[57] ABSTRACT

A tray for organizing wrenches of various sizes in a multi-wrench set, in the form of a tray having a support base, front and rear walls, side walls and at least two rows of dowel elements, the rows being spaced apart from one another and the dowels of each row being spaced apart from one another such that a wrench can be engaged at each end thereof with a dowel of each row and disposed horizontally therebetween. The rows of dowel elements can be mounted directly to the base or can be provided on insert members which can be selectively placed on the base and selectively spaced from one another so as to accommodate the particular wrenches of a set.

17 Claims, 1 Drawing Sheet

WRENCH ORGANIZER TRAY

BACKGROUND OF THE INVENTION

The present invention relates to kits or assemblies for functional organization of tools, in particular, to a tray assembly for wrenches.

A problem common to mechanics, repair people and individuals alike is the storage of wrenches. This is particularly true due to the varies sizes, lengths and types of wrenches required for a specific function.

For those who use wrenches, it would be desirable to provide a tray wherein the various wrenches can be organized in a functional manner addressing the storage requirements of the various sizes.

It would further be desirable to provide a tray which allows easy storage and retrieval of more than one of the various wrenches in a restricted position where size and type of wrench is readily apparent for proper selection.

SUMMARY OF THE INVENTION

The wrench organizer tray of the invention overcomes storage problems by enabling different lengths and sizes of wrenches to be stored in a single organizer tray in a manner such that their size can be readily ascertained. The tray of the invention, furthermore, retains the wrenches in a predetermined desired orientation during transport and use. Even further, with the tray of the invention, it is possible to immediately ascertain where a particular wrench should be stored as well as to store more than one wrench of a particular size.

The wrench organizer tray of the invention can be formed and the wrench receiving dowel elements mounted therewithin so that the orientation of the wrenches and the dimensions of the various wrenches stored therein are fixed. In the alternative, dowel carrying inserts can be provided so that the individual user can secure such inserts to the tray base in a manner which accommodates the particular sizes and types of wrenches which are to be stored in that organizer tray. The resulting wrench organizer tray may include one or more removable and replaceable inserts so that the varying requirements of the user and/or changes in the tool set number or type can be accommodated.

Other objects, features, and characteristics of the present invention as well as the methods of operation and functions of the related elements of the structure, and the combination of parts and economies of manufacture, will become more apparent upon consideration of the following description and appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
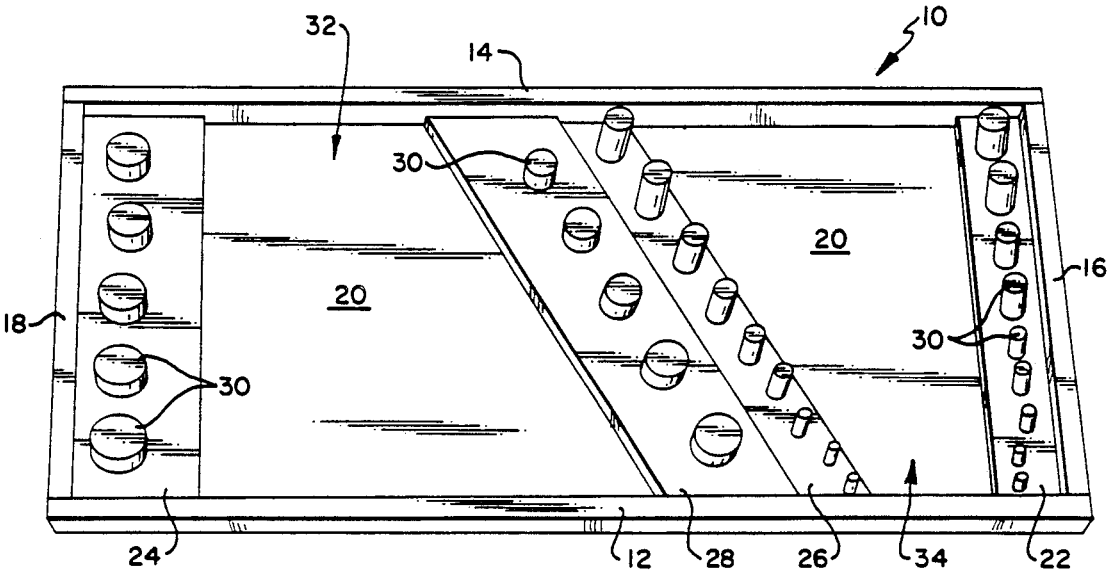
FIG. 1 is a front perspective view of a wrench organizer tray in accordance with the present invention without wrenches disposed therewithin.

The wrench organizer of the invention is in the form of a substantially rectilinear tray 10. As can be seen in FIG. 1, the wrench organizer tray includes a front wall 12, a rear wall 14, and first and second side walls 16, 18. The front, rear and side walls are interconnected by any suitable means at their intersecting edges to define the corners of the tray 10. A common base 20 is provided for the tray and is preferably disposed beneath and supports the walls of the tray. In the alternative, however, the base of the tray can be a rectilinear element inserted into the space defined by the walls and connected thereto by any suitable means. Thus, the base of the tray, whether in the form of a support base for the walls or an insert may be mechanically or adhesively attached to the walls. Yet another alternative, where the base of the tray is in the form of an insert, is to provide horizontal grooves (not shown) in each of the walls of the tray to slidably receive the insert which can in turn be fixed thereto with an adhesive or simply frictionally retained in such grooves.

A number of wrench mounting dowel elements are disposed within the tray between the walls and on the base. In the illustrated embodiment, two rectangular inserts 22, 24 are provided and two parallelogram inserts 26, 28 are provided, each of the inserts having a plurality of vertical dowel elements 30 mounted thereon. The parallelogram inserts 26, 28 are disposed in side-by-side relation in the central portion of the tray 10 whereas the rectangular inserts 22, 24 are disposed adjacent side walls 16, 18, respectively. As is further apparent, the position of the parallelogram inserts relative to the front and rear walls 12, 14 and relative to one another will determine the length of the wrenches which can be accommodated by the tray as well as the difference in lengths between wrenches mounted to adjacent pairs of dowel elements 30.

In the illustrated embodiment, dowel elements of various sizes are provided to accommodate wrenches which have openings and slots of various sizes. Thus, referring to the wrench-holding portion 32 defined on the left side of FIG. 1, an intermediate size wrench having an opening of, for example, $\frac{3}{4}$ inch can be mounted to a dowel element slightly smaller in diameter than the opening in the wrench, for example, 23/32 inch and extended across to a second dowel element which receives the slotted portion of the wrench. A next larger wrench can be disposed immediately adjacent the first wrench. Likewise, the wrench holding portion 34 defined on the right-side of the wrench organizer tray is provided for accommodating wrenches which are relatively short in length and have relatively small slots and apertures.

The dowel pins of each row may be disposed in a line or some dowel elements may be laterally offset from the line of the remaining dowel elements to accommodate wrenches which are particularly short in length. That is, if wrenches do not incrementally increase in length with increasing size, the dowel elements can be disposed so as to accommodate for such length variations. Likewise, the widths of the wrenches will determine spacing of the dowels along the inserts.

The depth of the tray and the height of the dowel elements as well as the thickness of each of the wrenches of the set will, of course, determine whether more than one wrench of a particular size can be mounted in the wrench organizer. It is envisioned that the wrenches of relatively small dimension which are mounted on the right side 34 of the tray are of small enough thickness that two or three wrenches of a particular size may be mounted one atop the other to the dowel elements. As shown in FIG. 1, furthermore, the dowel elements can be of varying height to allow a plurality of wrenches a particular size to be mounted thereto.

Figure 2:
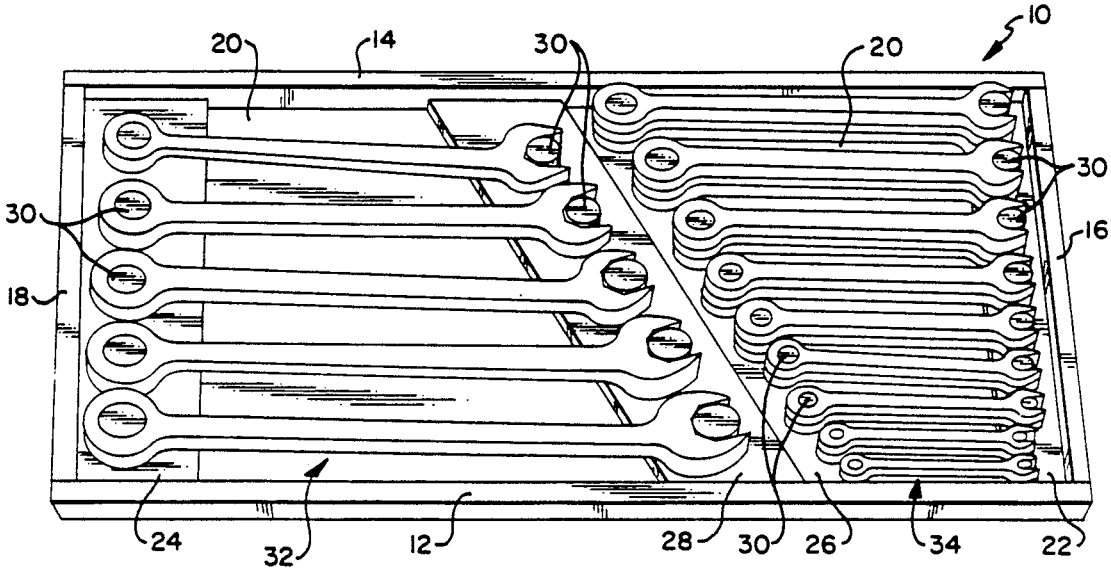
FIG. 2 is a front perspective view showing an organizer tray in accordance with the invention with wrenches disposed therewithin.

As is apparent from the foregoing and as illustrated in FIG. 2, the wrench organizer tray configured in the manner shown and described above with reference to FIG. 1 can accommodate a wrench set of various sizes with the smallest wrenches being disposed on the lower right-hand side. The wrenches progressively increase in both width and length towards the rear wall 14 of the organizer tray. Even larger wrenches in both length and diameter are disposed on the left-hand portion 32 of the tray in order of progressively increasing size to the largest wrench which is disposed in the lower left-hand side of the tray 10 as seen in FIG. 2. Because the dowel elements 30 in the right hand portion 32 are relatively greater in height as shown in FIG. 1, two or three wrenches can be mounted thereto as shown in FIG. 2.

The tray can be produced for individual use to accommodate a particular wrench set. Trays holding various wrench sets can be stacked one upon the other depending upon the dimensions of the storage area and the tool sets in the possession of the user. Thus, different organizational assemblies can be provided to accommodate various tool sets and stacked one atop the other so that a particular wrench set can be accessed and employed at a particular time.

While the invention has been described in connection with what is presently considered to be the most practical and preferred embodiment, it is to be understood that the invention is not to be limited to the disclosed embodiment, but on the contrary is intended to cover various modifications and equivalent arrangements within the spirit and scope of the appended claims. Thus, for example, the wrench organizer tray of the invention can be completely or partially preassembled or can be provided as a kit which can be assembled in a configuration particularly suited for a particular tool set or user's needs. Further, the various inserts can be removably or fixedly coupled together. Thus, should the particular tool set be such that a large number of components of a particular dimension are provided, rather than parallelogram inserts, two or more additional rectilinear inserts can be provided which are spaced apart a distance corresponding to the lengths of the various wrenches of the set. In such a system, a particular wrench organizer tray could be provided so that each tray holds wrenches of one particular length or wrenches of two particular lengths. Even further, the dowel elements, walls and base of the wrench organizer tray of the invention can be formed from any suitable material such as, for example, wood, metal or plastic without departing from this invention.

What is claimed is:

1. A wrench organizer tray comprising:

a support base member;

a first pair of parallel, spaced apart wall elements and a second pair of parallel spaced apart wall elements, said wall elements being coupled together and to said support base so as to define a tray; and at least first and second pairs of rows of dowel elements extending between the wall elements of said first pair of wall elements, one row of said first pair being parallel to one row of said second pair and said other row of said first pair being parallel to said other row of said second pair, said dowel elements having longitudinal axes extending substantially vertically upwardly from said support base.

2. A wrench organizer tray as in claim 1, wherein said dowel elements of each row vary in diameter along the length of said row so as to progressively increase in diameter from one wall element to the other wall element of said first pair.

3. A wrench organizer tray as in claim 1, wherein said one row of each said pair is disposed parallel to the wall elements of said second pair of wall elements.

4. A wrench organizer tray as in claim 3, wherein the other row of each said pair is disposed at an angle of less than 90° relative to said wall elements of said second pair of wall elements.

5. A wrench organizer tray as in claim 1, wherein said dowel elements are fixedly secured to insert elements, said insert elements being disposed on said support base.

6. A wrench organizer tray as in claim 5, wherein the inserts are releasably disposed on the support base.

7. A wrench organizer tray as in claim 1, wherein a spacing between each row of dowel elements of each pair is variable.

8. A wrench organizer tray as in claim 1, wherein a space between at least some adjacent dowel elements varies along the length of each row.

9. A wrench organizer tray as in claim 1, wherein at least some of said dowel elements have a height greater than others of said dowel elements.

10. A wrench organizer tray comprising:

a support base member;

a first pair of parallel, spaced apart wall elements and a second pair of parallel, spaced apart wall elements, said wall elements being coupled together and to said support base so as to define a tray; and at least first and second rows of discrete, substantially cylindrical dowel elements extending between the wall elements of said first pair of wall elements, said second row of dowel elements being defined at an angle of greater 0° and less than 90° with respect to said first row of dowel elements so as to define a gap of varying width therebetween, said dowel elements having longitudinal axes extending substantially vertically upwardly from said support base.

11. A wrench as in claim 10, wherein said dowel elements of each row vary in diameter along the length of said respective row so as to progressively increase in diameter from one wall element to the other wall element of said first pair of wall elements.

12. A wrench organizer tray as in claim 10, wherein at least first and second pairs of rows of dowel elements are provided, one row of said first pair being parallel to one row of said second pair and said other row of said first pair being parallel to said other row of said second pair.

13. A wrench organizer tray as in claim 12, wherein the other row of each said pair is disposed at an angle of less than 90° relative to said wall elements of said second pair of wall elements.

14. A wrench organizer tray as in claim 10, wherein said dowel elements are fixedly secured to insert elements, said insert elements being disposed on said support base.

15. A wrench organizer tray as in claim 14, wherein the inserts are releasably disposed on the support base.

16. A wrench organizer tray as in claim 10, wherein a space between at least some adjacent dowel elements varies along the length of each row.

17. A wrench organizer tray as in claim 10, wherein at least some of said dowel elements have a height greater than others of said dowel elements.

* * * * *